United States Patent [19]

Nassof

[11] Patent Number: 4,611,444

[45] Date of Patent: Sep. 16, 1986

[54] SANITARY ACOUSTICAL CEILING

[75] Inventor: Martin Nassof, Cliffside Park, N.J.

[73] Assignee: Simplex Ceiling Corp., Hoboken, N.J.

[21] Appl. No.: 707,030

[22] Filed: Feb. 28, 1985

[51] Int. Cl.[4] ..... E04B 1/82

[52] U.S. Cl. ..... 52/145; 52/484; 181/290; 181/295

[58] Field of Search ..... 52/145, 484, 403, 397; 181/295, 290; 55/385 A, 494

[56] References Cited

U.S. PATENT DOCUMENTS

| | | | |
|---|---|---|---|
| 1,867,549 | 7/1932 | Brockmeyer | 181/290 X |
| 2,729,431 | 1/1956 | Little | 181/290 X |
| 3,104,731 | 9/1963 | Ball, Jr. | 52/145 X |
| 3,308,586 | 3/1967 | Olson | 52/403 X |
| 3,509,671 | 5/1970 | Akerson | 52/145 |
| 4,317,503 | 3/1982 | Söderquist et al. | 181/290 |

FOREIGN PATENT DOCUMENTS

| | | | |
|---|---|---|---|
| 695374 | 10/1964 | Canada | 52/484 |
| 1108885 | 6/1961 | Fed. Rep. of Germany | 52/396 |

*Primary Examiner*—William F. Pate, III
*Assistant Examiner*—Jean M. LaKemper
*Attorney, Agent, or Firm*—Jacobs & Jacobs

[57] ABSTRACT

A suspended ceiling system for a room comprises a plurality of inverted T-shaped members suspended from the structural ceiling of the room and extending across the room, each T-shaped member having a horizontal base portion and a vertical leg portion; a plurality of open metal ceiling panels having two pairs of opposed sides and a bottom, and acoustical insulation in the panels, at least one pair of opposed sides being perforated; and each panel being supported by the inverted T-shaped members with the panel bottom and the pair of opposed perforated panel sides spaced from and facing the horizontal base portion and the vertical leg portion, respectively, of the pair of inverted T-shaped members.

6 Claims, 6 Drawing Figures

FIG. 1
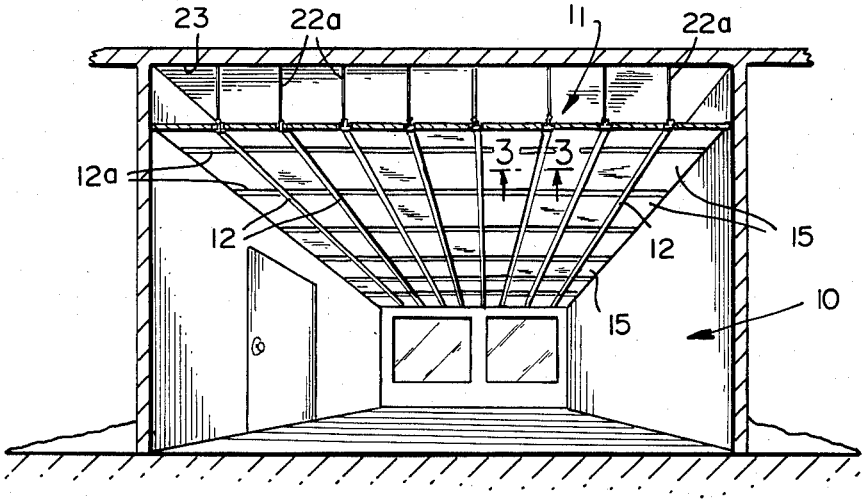
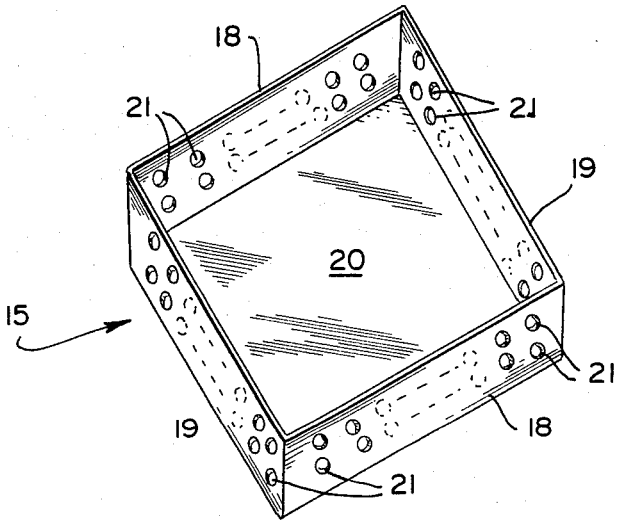
FIG. 2
FIG. 3
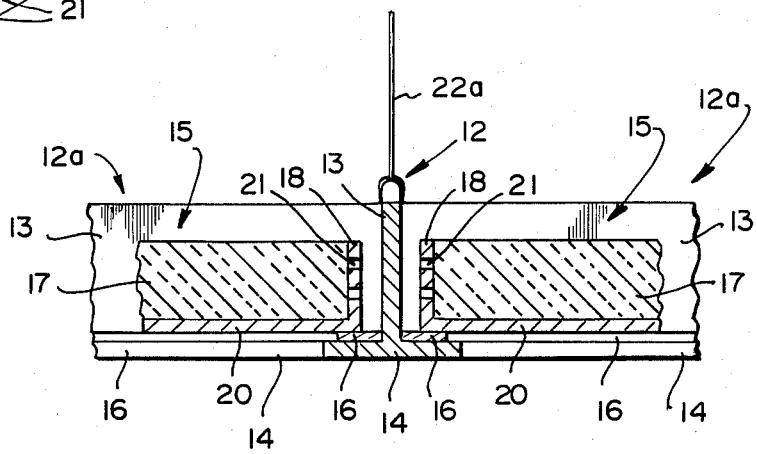

SANITARY ACOUSTICAL CEILING

The present invention relates to suspended ceiling systems based upon the use of metal ceiling panels, and more particularly to a suspended acoustical ceiling adapted for use in hospitals, kitchens and other areas that must be kept in a sanitary condition.

Suspended ceiling systems are known using metal ceiling panels that are filled with acoustical insulation for the purpose of absorbing sound waves. Such ceiling panels are provided with a perforated bottom to permit sound waves to pass through the metal ceiling panel and into the acoustical insulation. In hospitals, kitchens and other areas that must be kept in a sanitary condition, it is essential that the ceiling be non-porous and have exposed surfaces that lend themselves to day-to-day cleaning, and accordingly the conventional perforated metal ceiling panel containing acoustical insulation cannot be used these areas.

The present invention provides a sanitary acoustical ceiling system employing metal ceiling panels having an unperforated bottom and one or more perforated sides. Acoustical insulation material is carried by the metal ceiling panels, and the panels are suspended by an exposed, inverted T-shaped grid. One pair of opposed side walls of the metal ceiling panel, and preferably both pairs of opposed side walls, are provided with perforations to permit sound waves to pass through the perforated walls and into the acoustical insulation. The metal ceiling panels according to the present invention are supported on the inverted T-shaped members with the perforated side walls and the bottom of each panel spaced from the vertical leg and horizontal base, respectively, of the inverted T-shaped members. In this way, sound waves may pass through the gap between the metal ceiling panels and the inverted T-shaped members for absorption by the acoustical insulation carried by the metal ceiling panels.

In accordance with one embodiment of the invention, the upper surfaces of the base of the inverted T-shaped member carry an open cell foamed material to space the bottom of the metal ceiling panels from the horizontal base member. The cellular member permits sound waves to pass therethrough for absorption by the acoustical insulating material.

In another embodiment of the invention, the bottom of the metal ceiling panel is provided with projections at each corner, so that when the panel rests on the horizontal base portion of the inverted T-shaped member, the projections will space the bottom of the panel away from the horizontal base member. The gap thus created between the horizontal base member and the bottom of the panel will permit sound waves to pass between the panel and the horizontal base member and into the sound insulation.

The present invention is illustrated in terms of preferred embodiments in the accompanying drawings, wherein:

FIG. 1 is a perspective view of a room with a suspended ceiling according to the present invention;

FIG. 2 is a perspective view of a metal ceiling panel used in the present invention, but with the acoustical insulation omitted for clarity;

FIG. 3 is a view in section taken along lines 3—3 in FIG. 1;

Figure 4:
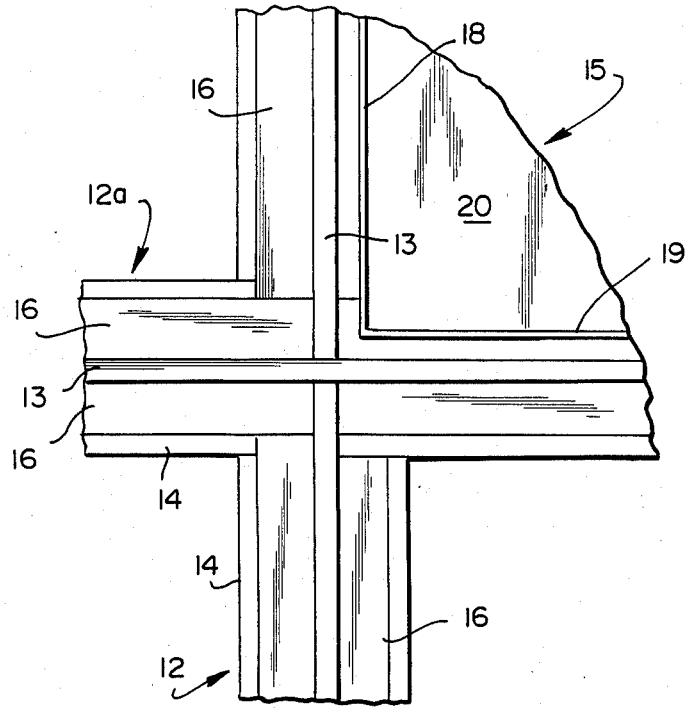
FIG. 4 is a detail plan view showing one panel resting on the cellular members carried by the inverted T-shaped members.

With reference to FIG. 1, room 10 is provided with a suspended ceiling 11 that extends substantially from wall-to-wall and end-to-end of the room. The suspended ceiling 11 is provided with an exposed T-grid based on the use of conventional inverted T-shaped members 12 that run longitudinally across the room and conventional inverted T-shaped members **12*a* that run transversly across the room. Members 12 and 12*a* support open metal ceiling panels 15 and are themselves carried by wires 22*a* that are hung from the structural ceiling 23**, all in a manner known per se.

FIG. 2 shows a metal ceiling panel 15 having opposed sides 18, 18 and 19, 19 and a bottom 20. Metal ceiling panel 15 may be made from any suitable material, such as galvanized steel or aluminum. In the embodiment shown in FIG. 2, all four sides 18, 18, 19, 19 are provided with perforation 21 so that there is preferably from about 40 to about 60% open area in each side 18, 19. However, the bottom 20 is imperforate so that its exposed face as viewed from below can be readily cleaned and kept sanitary. Metal ceiling panels 15 may be square or rectangular in shape and of any suitable size, and it is presently preferred to use square panels 15 that have one foot or two foot sides.

As seen in FIGS. 3 and 4, the inverted T-shaped members 12 and **12*a* are fitted together in a conventional manner to form a grid. The members 12 and 12*a* each have a vertical leg 13 and a horizontal base member 14, and the members 12*a* are notched so that the leg 13 of a member 12*a* will fit snugly against the leg 13 of a member 12. The leg 13 of the member 12 may be provided with an aperture (not shown) and the legs 13 of the members 12*a* may be provided with tongues (not shown) that fit into the apertures so that the members 12 and 12*a*** are locked together in a conventional manner.

As seen in FIGS. 3 and 4, the perforated sides 18 and 19 of the metal ceiling panels 15 are spaced from the legs 13 of the members 12 and **12*a*. The upper surfaces of the horizontal base members 14 carry an open cell cellular strip 16 so that when the bottom 20 of the panel 15 rests upon and is supported by the members 12 and 12*a*, the bottoms 20 will rest on the cellular member 16. Completing the assembly is acoustical insulation 17 that is carried in the metal ceiling panels 15. Acoustical insulation 17** may be any acoustical insulation, such as fire resistant mineral board.

Figure 5:
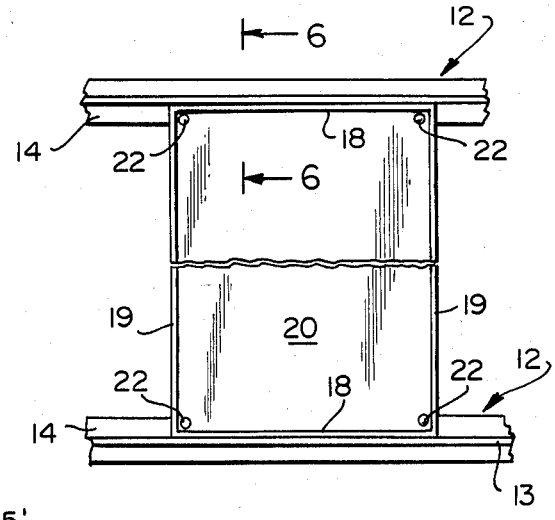
FIG. 5 is a plan view of an alternative embodiment of the invention.
Figure 6:
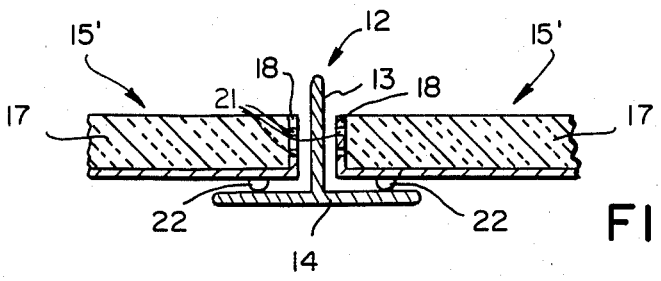
FIG. 6 is a view in section taken along lines 6—6 in FIG. 5.

FIGS. 5 and 6 illustrate an alternative embodiment of the invention in which a metal ceiling panel 15' is used in which only the opposed sides 18 are perforated. Furthermore, the ceiling system employs only the longitudinally extending inverted T-shaped members 12 to support the metal ceiling panels 15'. In addition, the metal ceiling panel 15' is provided with a foot 22 at each corner of the panel 15'. Feet 22 are preferably integral with the panel 15' and may be formed by punching the upper face of the bottom 20. As seen in FIG. 6, the perforated ends 18 are spaced from the vertical leg 13 of the member 12 and the feet 22 space the bottom 20 of each panel 15' from the upper surface of the horizontal base member 14.

In all of the embodiments shown in the drawings, the bottom 20 will be spaced from the upper surface of the horizontal base member 14 to provide a gap through which sound waves may pass. It is presently preferred to use a gap of about $\frac{1}{8}''$ wide, but other suitable dimensions can be used, such as within the range of from about 1/16" to about $\frac{1}{2}''$. The opposed perforated sides 18 and/or 19 will likewise be spaced from the vertical leg 13 by about the same distance. When the perforated sides 18 and/or 19 and the bottom 20 are thus spaced from the vertical leg 13 and the upper surface of the horizontal base member 14, respectively, sound waves can pass through the gap thus created and be deflected by the vertical leg directly through the perforation 21 or they can be deflected by the vertical leg 13 and pass upwardly to the structural ceiling 23, whereupon they are deflected back towards the sound insulation 17. Since the bottom 20 of each of the panels 15, 15' is unperforated, the panels 15, 15' may be cleaned and disinfected on a day-to-day basis, thereby providing a sanitary acoustical ceiling.

Any open cell cellular material may be used as cellular material 16, such as an open cell rigid polyurethane foam. Open cell flexible polymeric foam may be used, because the panel 15 or 15' with acoustical insulation 17 is very light in weight and will not appreciably compress the flexible foam.

I claim:

1. A suspended ceiling system for a room, which comprises a plurality of inverted T-shaped members suspended from the structural ceiling of the room and extending across the room, each said T-shaped member having a horizontal base portion and a vertical leg portion;

a plurality of open metal ceiling panels having two pairs of opposed sides and an unperforated bottom, and acoustical insulation in said panels, at least one pair of opposed sides being perforated, and each said panel being supported by a pair of said inverted T-shaped members with said panel bottom and said pair of opposed perforated panel sides spaced from and facing said horizontal base portion and said vertical leg portion, respectively, of said pair of inverted T-shaped members.

2. The ceiling according to claim 1, wherein an open cell cellular member is provided on said horizontal base portion of said pair of inverted T-shaped members and said panel bottom rests on said cellular member.

3. The ceiling according to claim 1, wherein said panel bottom has foot means at each corner, said panels being supported on said base portions of said inverted T-shaped members with said foot means on said base portions.

4. A suspended ceiling system for a room, which comprises a plurality of inverted T-shaped members suspended from the structural ceiling of the room and extending longitudinally and transversely across the room, each said T-shaped member having a horizontal base portion and a vertical leg portion;

a plurality of open metal ceiling panels having two pairs of opposed perforated sides and an unperforated bottom, and acoustical insulation in said panels; and each said panel being supported by a pair of opposed longitudinally extending and a pair of opposed transversely extending inverted T-shaped members with said panel bottom and said opposed perforated panel sides spaced from and facing said horizontal base portion and said vertical leg portion, respectively, of said pairs of opposed inverted T-shaped members.

5. The ceiling according to claim 4, wherein an open cell cellular member is provided on said horizontal base portion of said pairs of opposed inverted T-shaped members and said panel bottom rests on said cellular member.

6. The ceiling according to claim 4, wherein said panel bottom has foot means at each corner, said panels being supported on said base portions of said inverted T-shaped members with said foot means on said base portions.

* * * * *